US007233896B2

(12) United States Patent
Adut

(10) Patent No.: US 7,233,896 B2
(45) Date of Patent: Jun. 19, 2007

(54) REGULAR-PULSE EXCITATION SPEECH CODER

(75) Inventor: Victor Adut, Woodstock, IL (US)

(73) Assignee: Motorola Inc., Schaumburg, IL (US)

( * ) Notice: Subject to any disclaimer, the term of this patent is extended or adjusted under 35 U.S.C. 154(b) by 883 days.

(21) Appl. No.: 10/208,389

(22) Filed: Jul. 30, 2002

(65) Prior Publication Data

US 2004/0024597 A1 Feb. 5, 2004

(51) Int. Cl.
*G10L 19/12* (2006.01)

(52) U.S. Cl. ..... 704/223; 704/220; 704/221

(58) Field of Classification Search ..... 704/223, 704/220–221, 212

See application file for complete search history.

(56) References Cited

U.S. PATENT DOCUMENTS

| | | | | |
|---|---|---|---|---|
| 4,736,428 | A | 4/1988 | Deprettere et al. | |
| 4,932,061 | A | 6/1990 | Kroon et al. | |
| 5,127,054 | A | 6/1992 | Hong et al. | |
| 5,794,186 | A * | 8/1998 | Bergstrom et al. | 704/223 |
| 6,199,040 | B1 | 3/2001 | Fette et al. | |
| 6,311,154 | B1 * | 10/2001 | Gersho et al. | 704/219 |
| 6,597,787 | B1 * | 7/2003 | Lindgren et al. | 379/406.05 |
| 6,928,406 | B1 * | 8/2005 | Ehara et al. | 704/223 |
| 2001/0023396 | A1 * | 9/2001 | Gersho et al. | 704/220 |

OTHER PUBLICATIONS

Deller et al. "discrete-time processing of speech signal", 1993, ISBN 0-02-328301-7, pp. 474-476.*

Kroon, P. et al. "Regular-Pulse Excitation—A Novel Approach to Effective Multipulse Coding of Speech." *IEEE Transactions On Acoustics, Speech and Signal Processing*, vol. ASSP-34, No. 5, Oct. 1986, pp. 1054-1063.

Un, C.K. et al. "The Residual-Excited Linear Prediction Vocoder With Transmission Rate Below 9.6 kbits/s." *IEEE Transactions on Communications*, vol. COM-23, Dec. 1975, pp. 1466-1474.

Viswanathan, V. et al. "Design of a Robust Baseband LPC Coder for Speech Transmission over 9.6 Kbit/s Noisy Cannels." *IEEE Transactions of Communications*, vol. COM-3-, No. 4, Apr. 1982, pp. 663-673.

(Continued)

*Primary Examiner*—Richemond Dorvil
*Assistant Examiner*—Qi Han
(74) *Attorney, Agent, or Firm*—Brian M. Mancini; Randall S. Vaas

(57) ABSTRACT

A method for providing synthesized speech using regular-pulse excitation includes a first step (300) of processing input speech to provide a residual excitation signal. A next step (302) includes defining important samples of the residual signal. Low frequency residual signals are particularly important. A next step (304) includes coding the important samples using regular-pulse excitation. A next step includes storing the important samples to random regular-pulse excitation grid positions in a memory using a first set of pseudorandomly generated numbers to assign the grid positions of each of the important samples. In this way, code rate for controlled, voice-only signals can be increased. This best applies to non-real time speech storage of voice tags, prompts and messaging.

16 Claims, 3 Drawing Sheets

OTHER PUBLICATIONS

Chen, J. et al. "Adaptive Postfiltering For Quality Enhancement of Coded Speech." *IEEE Transactions on Speech and Audio Processing*, vol. 3, No. 1, Jan. 1995, pp. 59-71.

Kemp, D.P. et al. "Multi-Frame Coding of LPC Parameters at 600-800 BPS." IEEE 1991, pp. 609-612.

Wong, D. Y-K "Issues on Speech Storage." *IEEE Colloquium on Speech Coding Techniques*, 1992, pp. 711-714.

European Telecommunications Standards Institute, "Digital Cellular Telecommunications systems (Phase 2+): Full Rate Speech; Transcoding (GSM 06.10 version 5.1.1)", May 1998.

Specifications for the Analog to Digital Conversion of Voice by 2,400 Bit/Second Mixed Excitation Linear Prediction, Draft, May 28, 1998.

* cited by examiner

REGULAR-PULSE EXCITATION SPEECH CODER

FIELD OF THE INVENTION

The present invention relates in general to a system for digitally encoding speech, and more specifically to a system for speech coding.

BACKGROUND OF THE INVENTION

Several new features recently emerging in radio communication devices, such as cellular phones, and personal digital assistants require the storage of large amounts of speech. For example, there are application areas of voice memo storage and storage of voice tags and prompts as part of the user interface in voice recognition capable handsets. Typically, recent cellular phones employ standardized speech coding techniques for voice storage purposes.

Standardized coding techniques are mainly intended for real time two-way communications, in that, they are configured to minimize buffering delays and achieving maximal robustness against transmission errors, maximal robustness against multiple encodings, and the ability to operate with non-voiced signals. Clearly, for voice storage tasks, neither buffering delays nor robustness against transmission errors, multiple encodings, and non-voiced signals are of any consequence. Moreover, the timing constraints, error correction, and noise immunity require higher data rates for improved transmission accuracy.

Although speech storage has been discussed for multimedia applications, these techniques simply propose to increase the compression ratio of an existing speech codec by adding an improved speech-noise classification algorithm exploiting the absence of coding delay constraint. However, in the storage of voice tags and prompts, which are very short in duration, pursuing such an approach is pointless. Similarly, medium-delay speech coders have been developed for joint compression of pitch values. In particular, a codebook-based pitch compression and chain coding compression of pitch parameters have been developed. However, none of these approaches take advantage of the voice-only, quiet environment, single encoder requirements for the storage of voice tags or prompts to further improve data compression efficiency.

Therefore, there is a need for a codec with a higher compression ratio (lower data rate) than conventional speech coding techniques for use in dedicated voice storage applications. In particular, it would be an advantage to use randomization criteria in a dedicated speech codec. It would also be advantageous to provide these improvements without any additional hardware or cost.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

Figure 1:
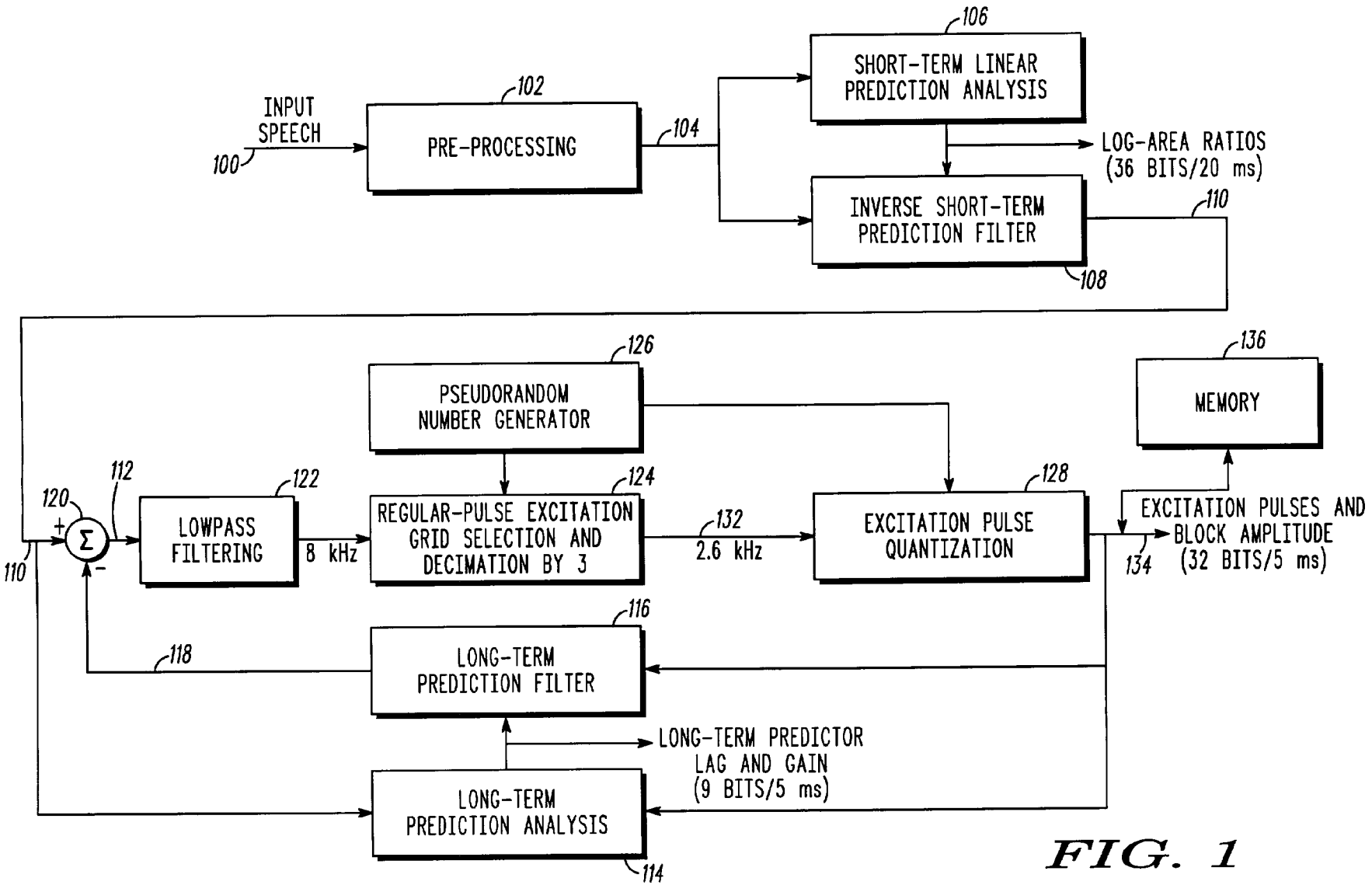
FIG. 1 shows a block diagram of a speech encoder system, in accordance with the present invention.

The exemplification set out herein illustrates a preferred embodiment of the invention in one form thereof, and such exemplification is not intended to be construed as limiting in any manner.

DETAILED DESCRIPTION OF THE PREFERRED EMBODIMENTS

The present invention develops a lower-bit rate speech codec that has beneficial use for storage of voice tags and prompts. This invention uses randomization criteria regular-pulse excitation grid positioning and quantization used in modeling human speech. Customary speech coders were developed for deployment in real-time two-way communications networks, which imposes stringent requirements on buffering delays, noise, channel errors, and non-voiced signals. Obviously, in speech storage applications these considerations are not of any consequence. Removal of these constraints enables an increased compression ratio in the present invention.

In particular, the present invention is an improvement of the Global System for Mobile Full-Rate (GSMFR) speech coder using regular-pulse excitation (RPE), as described in, European Telecommunications Standards Institute, "Digital Cellular Telecommunications System (Phase 2+); Full rate speech; Transcoding (GSM 06.10 version 5.1.1)", May 1998, hereby incorporated by reference. The present invention reduces the bit rate of GSMFR from 13 kbps to about 10 kbps. This 25% improvement comes without any additional computational complexity, and also provides acceptable quality for voice memo applications at higher compression ratios, which is primarily suitable for use in speech storage applications. Subjective listening experiments confirm that the codec of the present invention meets the speech quality and intelligibility requirements of the intended voice storage application and voice messaging for multimedia capable phones, such as a voice-based variant of SMS (short message service) for GSM phones, for example.

Several features incorporated into the improved GSMFR model, in accordance with the present invention, enable the efficient storage of voice tags and prompts. These improvements come at insignificant overhead (both in terms of code space and computational complexity), and can be easily incorporated into an existing radio communication device using a GSMFR coder for speech storage or transmission.

As is known in the art, RPE belongs to the family of linear predictive vocoders that use a parametric model of human speech production. The goal is producing perceptually intelligible speech without necessarily matching the waveform of the encoded speech. The transfer function of the human vocal tract is modeled with an all-pole linear long-term prediction filter and an all-pole linear short-term prediction filter to produce synthesized speech. Similar to the human vocal tract, these linear prediction filter are driven by an excitation signal consisting of a regularly periodic pulse train.

The present invention involves reducing the bit rate of the excitation signal. Bit rate reduction is achieved by exploiting the differences between the characteristics of speech storage and speech transmission tasks. GSMFR is designed for real-time communication applications over noisy channels. Clearly, voice storage and voice messaging applications have much less demanding requirements. The description below briefly elaborates on the factors that differentiate speech storage applications from customary speech coding tasks intended for real-time communications. Among these factors are (a) robustness against channel errors, (b) robustness against multiple encodings, and (c) ability to operate with a large variety of signals.

Robustness against channel errors: Standard cellular telephone speech codecs are required to correct for high bit error rates. One technique to accomplish this provides self-correcting codes to produce good quality speech even when some of the transmitted parameters are corrupted. For example, the GSM standard provides for the insertion of error correction bits during channel coding. Clearly, this extra information is not required in speech storage applications. This is exploited to achieve lower bit rates, which operates at a perceptual level, and ensures that even if some of the parameters used to model speech are destroyed, good quality speech is still produced.

Robustness against multiple encodings: GSMFR is expected to operate successfully in tandem with a variety of speech coders used across the communication chain. This requirements can be relaxed in the context of voice storage and voice messaging applications.

Ability to operate with a large variety of signals: GSMFR is designed to handle a large variety of input signals, such as DTMF tones, non-speech signals, various background noises, etc. The only known efficient way of fighting background noise is increasing the bit rate. On the other hand, stored voice prompts are recorded in controlled studio conditions, under complete absence of background noise. Similarly, voice tags are recorded during a voice recognition training phase, which is usually carried in a silent, controlled setting. Further voice prompts are recorded under controlled studio conditions.

Figure 2:
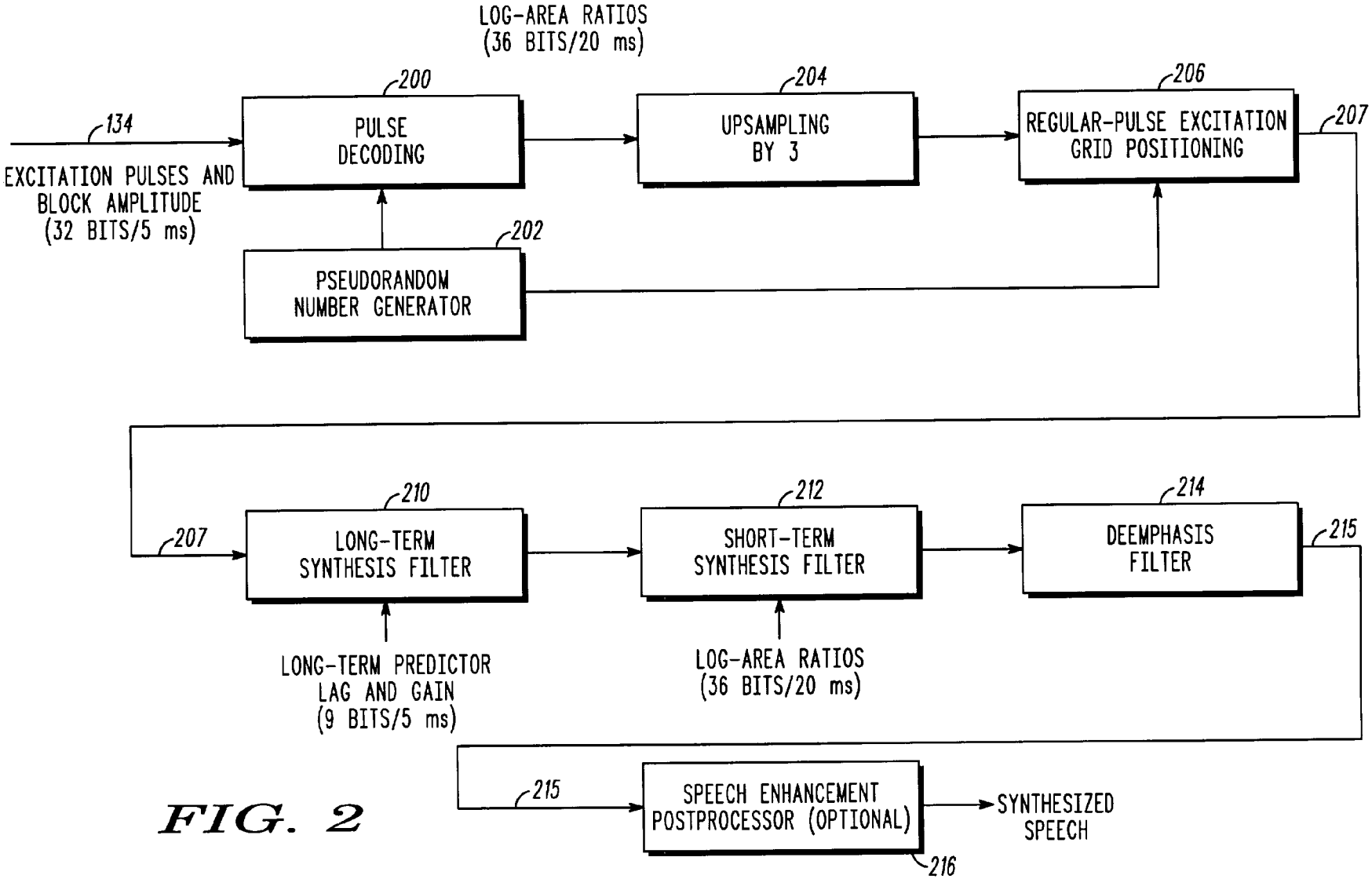
FIG. 2 shows a block diagram of a speech decoder system, in accordance with the present invention.

FIGS. 1 and 2 are block diagrams of an RPE encoder and decoder, respectively, in accordance with the present invention. As in GSMFR, input speech is sampled at 8 kHz using 13-bit uniform quantization. The same procedures are used by GSMFR and the present invention for computing the long-term and short-term linear prediction filters. Due to these similarities, the discussion below shall largely be based on the distinctions between GSMFR and the present invention. Such a presentation helps to emphasize the application of the principles of the present invention. The primary difference is in the excitation modeling, wherein the present invention uses 6.4 kbps to represent the linear predictive excitation signal (see Table 1), and GSMFR allocates 9.4 kbps for the same purpose. In particular, the present invention replaces the regular-pulse excitation grid positions and the least significant bits of the excitation pulses with pseudorandom numbers, as will be described in detail below.

FIG. 1 shows a simplified block diagram of a RPE encoder, in accordance with the present invention. Digitized input speech 100 is entered into a pre-processing block 102. The pre-processing block 102 removes an offset in the signal and filters the signal to provide pre-emphasis, as is known in the art. The output signal 104 is then sampled and analyzed, using known techniques, in a short-term linear prediction analyzer 106 to determine the reflection coefficients for a short-term prediction filter 108. The reflection coefficients are converted to log-area ratios before transmission. The short-term prediction filter 108 filters the output signal 104 of the pre-processing block 102 to provide samples of a short-term residual signal 110.

The short-term residual signal 110 is sampled and analyzed in blocks, using known techniques, in a long-term linear prediction analyzer 114 to estimate and update long-term predictor lag and gain parameters for a long-term prediction filter 116. The long-term prediction analyzer block 114 estimates and updates the long-term predictor lag and gain using the currently entered and previously stored short-term residual samples, as is known in the art. The long-term prediction filter 116 provides estimates 118 of the short-term residual signal.

A block samples of a long-term residual signal 112 is then obtained by subtracting 120 the estimates 118 of the short term residual signal from the short term residual signal 110 itself. The block of samples of the long-term residual signal 112 is then low-pass filtered to provide 8 kHz samples to the Regular Pulse Excitation analyzer 124, which performs a data compression function in accordance with the present invention. For example, The signal entering block 124 is sampled at 8 kHz. Next, it is processed at 5 ms subframes (40 samples), and after downsampling by three, thirteen samples per subframe are retained. Given there are 200 subframes per second, this gives an output signal with sampling frequency 200*13=2600 Hz or 1.3 kHz bandwidth. Preferably, the lowpass filtering 122 has a cutoff frequency of 1300 Hz. Of a typical 13 samples per block, the block amplitude is compressed to 6 bits, and each sample is normalized and compressed to 3-bits per sample.

The analyzer 124 downsamples or decimates samples of the input long-term residual signal by three. This is done by selecting one of four sample sub-sequences identified by a regular-pulse excitation grid position. In the prior art GSMFR coder, the analyzer 124 prioritizes grid positions depending on the energy level of the residual signal samples, the highest energy level samples being the most important. The residual excitation signals of the important samples are then constrained to selected grid positions. The GSMFR coder selects the regular-pulse grid positions such that the mean-square error between the unquantized and quantized linear prediction residuals are minimized. The RPE parameters (log-area ratios, LTP lag and gain) including the important samples and their grid positions are then encoded with an estimation of the sub-block amplitude, which is transmitted to a decoder as side information.

In contrast, a novel aspect of the present invention does not sort the grid-positions by importance. Under the relaxed constraints of a speech storage application envisioned for this invention, it is not necessary to use the optimal grid positions. It has been established that from a perceptual point of view it is most important to encode the low frequency portion (less than 1000 Hz) of the linear prediction residual accurately. In other words, the present invention defines "important samples" as not those of the highest energy level, but as the low frequency samples of the residual signals processed from the input speech. In this way, the present invention benefits from the higher error margin that can be tolerated in the higher frequency regions of the residual signal. Moreover, these highpass regions of the residual signal can be easily approximated using spectral flattening or other high frequency regeneration technique to further enhance intelligibility.

The present invention provides a novel technique using a pseudorandom number generator 126 that generates numbers to pseudorandomly select sample positions in the RPE grid. Preferably, the pseudorandomly generated numbers are uniformly distributed 2-bit numbers (number between 0 and 3) as regular-pulse excitation grid positions. Specifically, The output of the lowpass filter 122 is divided to non-overlapping 40 sample (or 5 ms) subframes, which are then passed through a first random delay element $z^{M(k)}$ where M(k) is the sequence of pseudorandom numbers (or grid positions) from the pseudorandom number generator 126. The pseudorandom numbers are constrained as follows. (i) $0 \leqq M(k) \leqq 3$ (or alternatively $-3 \leqq M(k) \leqq 0$); and (ii) $M(40n+i)=M(40n)$ where n is an integer and $0 \leqq i \leqq 39$. In other words, (ii) implies that the value of M(k) is updated only once every subframe. The output of the random delay element x(k) is decimated (downsampled) by a factor of 3.

This high frequency regeneration technique preserves the lowpass region of the excitation train while introducing some randomness to the high frequency regions of the reconstructed speech. The RPE parameters including the bits in the pseudorandomly selected grid positions are then encoded with an estimation of the sub-block amplitude, which is stored in a memory 136 or transmitted to a decoder as side information in a 2.6 kHz signal 132. Since grid position need not be separately determined or transmitted, computational time and the number of bits transmitted are reduced over the GSMFR codec.

The RPE parameters 132 are input to an excitation pulse quantizer 128 to provide a quantized version 134 of the long term residual signal. The quantizer operates on 13 sample (or 5 ms) blocks. For each block, the quantized block amplitude and quantized normalized pulse amplitudes are stored to be used during encoding. The quantized samples are then subject to upsampling by a factor of 3, and applied to a second random delay element, similar to the first delay element described above, to reconstruct the residual signal, which is used in determination of long-term predictor gain and lag. The pseudorandom number sequence used is identical and synchronous to the pseudorandom number used by the first random delay element.

Another novel aspect of the present invention is the reduction of the 3-bit quantization of samples to 2-bit quantization. This can be done directly through a custom configuration. However, it is easier to use the existing GSMFR 3-bit coder to simply provide 2-bit quantization, instead of supplying a separate, custom configuration. 2-bit quantization is accomplished by coupling the pseudorandom number generator 126 to the quantizer 128, as described above. The pseudorandom number generator 126 provides a pseudorandom number to replace at least one bit of the 3-bit quantization, resulting in a 2-bit quantization. Preferably, the pseudorandom number generator 126 provides 1-bit, uniformly distributed, pseudorandom numbers to replace the least significant bit of each 3-bit quantization. It is necessary to supply random numbers here, instead of setting all the least significant bits to zero or one, to prevent the introduction of systemic errors (bias). Alternatively, the one least significant bit can be set to the inverse of the most significant bit, or set equal to the most significant bit. In either case, the mean value of the reconstructed pulses does not change. In other words, none of these methods introduce an additional DC bias.

As an example, the GSMFR coder generates 3-bit quantized samples. These quantized samples 134 of the long-term residual signal are added to a previous block of short-term residual signal estimates to obtain a reconstructed version of the current short term residual signal. A block of reconstructed short term residual signal samples is then fed to the long-term prediction filter to produces a new block of short-term residual signal estimates 118 to be used for the next sub-block, thereby completing the feedback loop.

The bit allocation and frame format of the present invention is shown in Table 1.

TABLE 1

RPE bit allocation per 20 ms/200 bits frame.

| Parameters | Number of bits | Update frequency per frame | Total number of bits per frame |
|---|---|---|---|
| Short-term predictor log-area ratios | 36 | 1 | 36 |
| Long-term predictor lag | 7 | 4 | 28 |
| Long-term predictor gain | 2 | 4 | 8 |
| Excitation pulse block amplitude | 6 | 4 | 24 |
| Excitation pulses | 26 | 4 | 104 |

The primary differences between the present invention and the GSMFR codec is that the present invention does not calculate or transmit grid positions and uses 2-bit quantization instead of 3-bit quantization. As a result, there are no bits transmitted for grid positions, and the number of excitation pulses is reduced over that of the GSMFR. Therefore, the present invention uses 6.4 kbps to represent the linear predictive excitation signal, whereas the GSMFR codec uses 9.4 kbps for the same purpose.

FIG. 2 shows a simplified block diagram of a RPE decoder in accordance with the present invention, to complement the encoder of FIG. 1. The decoder uses a complementary (or the same) pseudorandom number generator 202, in a similar feedback loop structure as in the encoder of FIG. 1. The pseudorandom number generators in the encoder and decoder must be synchronized, if they are not the same. This synchronization ensures that the same grid positions are used in the analysis and synthesis phases of the codec. In order to maintain synchronization, it is sufficient to reset the pseudorandom number generators at the beginning of each stored speech segment.

The transmitted or stored 2-bit RPE parameters 134 are input to the decoder, using a standard GSMFR pulse decoder 200. A pseudorandom number generator 202 supplies the same pseudorandom 1-bit numbers to a delay element in the decoder as in the second random delay element in the encoder (in block 128 of FIG. 1) to reconstruct the 3-bit quantization. Alternatively, a custom pulse decoder can be supplied to directly operate on the 2-bit quantized samples. However, using the 3-bit quantization makes the present invention adaptable to the standard GSMFR configuration, allowing an easier implementation. The output of the pulse decoder 200 is upsampled by 3 in an upsampling block 204. This output is then fed to a regular-pulse excitation grid positioning block where the samples are subject to a random delay element, as was done in the first random delay element in the encoder (in block 124 of FIG. 1), driven by the same pseudorandom number sequence as before, as provided by the pseudorandom number generator 202, to recreate the grid positions.

In a standard GSMFR decoder, this block would ordinarily need to input the grid positions to properly position the samples. However, the present invention uses the pseudorandom number generator 202 to recreate the randomly selected grid positions (used in the block 128 of FIG. 1). Since the grid positions are recreated, there is no need for transmitting the grid positions to the decoder, as is done GSMFR, thereby lowering the bit rate.

The output 207 of this stage will ideally be the reconstructed short term residual samples. These samples 207 are then applied to the long-term synthesis filter 210, which is driven by the transmitted RPE parameters (LTP lag and gain), and then to the short-term synthesis filter 212, which is driven by the transmitted RPE parameters (log-area ratios). This is followed by the de-emphasis filter 214 resulting in the reconstructed speech signal samples. The operation of these blocks 210, 212, 214 is the same as for the GSMFR decoder.

Optionally, the synthesized speech signal 215 can be passed through a speech enhancement postprocessor 216. This postfilter module includes an adaptive filter to improve speech quality by boosting formant frequencies.

Figure 3:
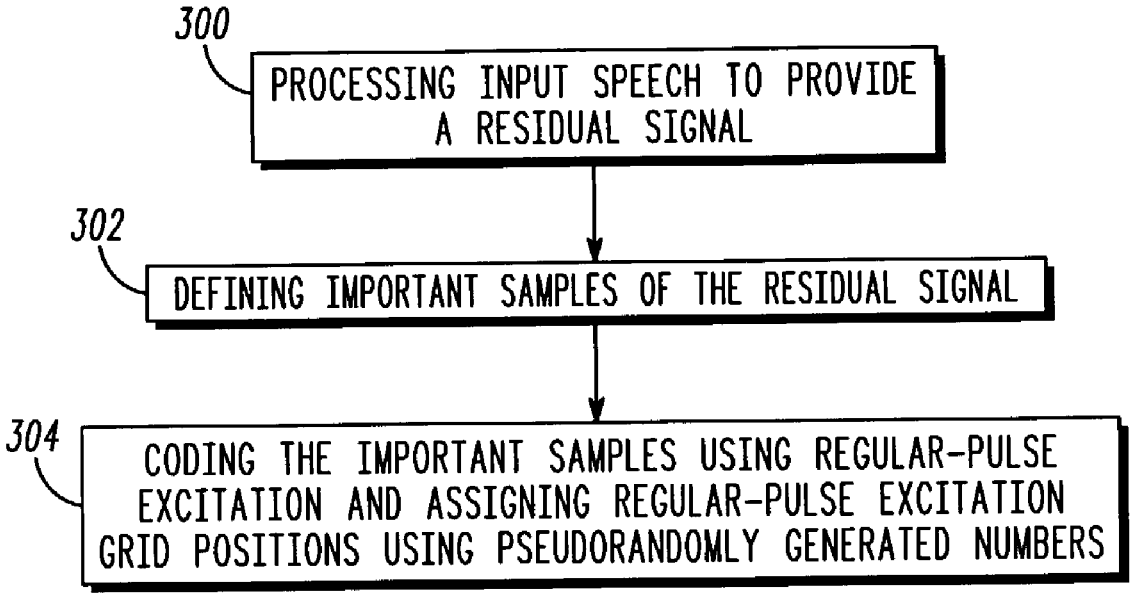
FIG. 3 shows a simplified flow chart of a method for coding speech using regular-pulse excitation, in accordance with the present invention.

The present invention also includes the following method for coding speech using regular-pulse excitation, as represented in FIG. 3. A first step 300 includes processing input digitized speech to provide a residual excitation signal. A next step 302 includes defining important samples of the residual excitation signal. The important samples being those providing higher signal quality. In particular, low frequency samples (less than 1300 Hz) are found most important in speech intelligibility. Therefore, it is preferred that this step includes lowpass filtering to select the important samples. A next step 304 includes coding the important samples using regular-pulse excitation and pseudorandomly assigning regular-pulse excitation grid positions using a first set of pseudorandomly generated numbers. Preferably, this step includes the substeps of decimating the coded samples by three, and quantizing each decimated sample to at least two-bits. In general, the quantizing substep includes replacing one of the bits of each the decimated samples with a random bit from a second set of pseudorandomly generated numbers. Preferably, the one of the bits of each the decimated samples is the least significant bit. This introduces some randomness to the higher frequency signals. The resulting signals are then stored as voice tags or prompts to be recalled or transmitted to, and processed by a decoder.

Therefore, the present invention can also include the steps of pulse decoding each quantized sample using the same bit from the second set of pseudorandomly generated numbers that was used in the quantizing substep, and positioning the decoded samples using the assigned grid positions from the first set of pseudorandomly generated numbers to provide synthesized speech. Preferably, the present invention includes the step of decoding the important samples from the assigned grid positions using the first set of pseudorandomly generated numbers to provide synthesized speech.

Optionally, the method of the present invention can includes a step of filtering the synthesized speech through a speech enhancement postfilter, to improve speech quality by boosting formant frequencies.

The method of the present invention provides reduced bit rate over an existing GSMFR codec by using known random number sequences to assign RPE grid positions and reducing quantization by one bit. This reduces the amount of data to be stored or transmitted by eliminating the transmission/storage of grid positions and reducing sample quantization size.

EXAMPLE

In order to assess the speech intelligibility of the improved codec of the present invention, a small scale diagnostic rhyme test (DRT), as is known in the art, was performed. In this listening test, three listeners are presented with word pairs differing only in one vowel or consonant, and they identify which word is heard. The reference codec was GSMFR. For 96 total number of word pairs, the GSMFR codec received a DRT score of 93%, while the codec of the present invention received a DRT score of 91%, which is very close to the GSMFR score. Standardized speech coders usually have a score above 90%. In a second, subjective A/B (pairwise) listening test, to compare the present invention to the GSMFR codec, listeners compared the controlled speech storage output of voice tags and prompts, which are of higher quality than typically tested. In this case, the listeners found little difference between present invention and the GSMFR codec. In accordance with these results, the quality of the present invention is judged to be sufficient for a voice storage applications and voice messaging in multimedia capable communication devices.

In summary, the present invention provides a simplified method of regular-pulse excitation generation that is based on pseudorandom number generation. The present invention exploits the reduced computational complexity by providing a speech compression technique and rate reduction not addressed in a speech coder before. As supported by the listening experiments described above, the present invention can be used to attain increased compression ratios without adversely affecting speech quality.

Although the invention has been described and illustrated in the above description and drawings, it is understood that this description is by way of example only and that numerous changes and modifications can me made by those skilled in the art without departing from the broad scope of the invention. Although the present invention finds particular use in portable cellular radiotelephones, the invention could be applied to any multi-mode wireless communication device, including pagers, electronic organizers, and computers. Applicants' invention should be limited only by the following claims.

What is claimed is:

1. A method for coding speech using regular-pulse excitation, the method comprising the steps of:

processing input speech to provide a residual signal;

defining important samples of the residual; and coding the important samples using regular-pulse excitation and pseudorandomly assigning regular-pulse excitation grid positions using a first set of pseudorandomly generated numbers;

wherein the coding step includes the substeps of decimating the coded samples by three, and quantizing each decimated sample to at least two bits; and wherein the quantizing substep includes replacing one of the bits of each the decimated samples with a random bit from a second set of pseudorandomly generated numbers.

2. The method of claim 1, wherein the one of the bits of each the decimated samples is the least significant bit.

3. The method of claim 1, wherein the defining step includes the substep of lowpass filtering to select the important samples.

4. A method for coding and decoding speech coded using regular-pulse excitation, the method comprising the steps of:

processing input speech to provide a residual signal;

defining important samples of the residual;

coding the important samples using regular-pulse excitation and pseudorandomly assigning regular-pulse excitation grid positions using a first set of pseudorandomly generated numbers;

wherein the coding step includes the substeps of decimating the coded samples by three, and quantizing each decimated sample to at least two bits;

wherein the quantizing substep includes replacing one of the bits of each the decimated samples with a random bit from a second set of pseudorandomly generated numbers; and further comprising the steps of:

pulse decoding each quantized sample using the same bit from the second set of pseudorandomly generated numbers that was used in the quantizing substep; and positioning the decoded samples using the assigned grid positions from the first set of pseudorandomly generated numbers to provide synthesized speech.

5. The method of claim 4, further comprising the step of decoding the important samples from the assigned grid positions using the first set of pseudorandomly generated numbers to provide synthesized speech.

6. The method of claim 5, further comprising the step of filtering the synthesized speech through a speech enhancement postfilter.

7. A method for coding speech using regular-pulse excitation, the method comprising the steps of:

processing input digitized speech to provide a residual excitation signal;

defining important samples of the residual excitation signal per predetermined criteria;

coding the important samples using regular-pulse excitation and pseudorandomly assigning regular-pulse excitation grid positions using a first set of pseudorandomly generated numbers;

decimating the coded samples by three; and quantizing each decimated sample by replacing one of the bits of each the decimated samples with a random bit from a second set of pseudorandomly generated numbers.

8. The method of claim 7, wherein in the quantizing step the one of the bits of each the decimated samples is the least significant bit.

9. The method of claim 7, wherein the defining step includes the substep of lowpass filtering to select the important samples.

10. A method for coding speech using regular-pulse excitation and decoding speech, the method comprising the steps of:

processing input digitized speech to provide a residual excitation signal;

defining important samples of the residual excitation signal per predetermined criteria;

coding the important samples using regular-pulse excitation and pseudorandomly assigning regular-pulse excitation grid positions using a first set of pseudorandomly generated numbers;

decimating the coded samples by three; and quantizing each decimated sample by replacing one of the bits of each the decimated samples with a random bit from a second set of pseudorandomly generated number; and further comprising the steps of:

pulse decoding each quantized sample using the same bit from the second set of pseudorandomly generated numbers that was used in the quantizing substep; and positioning the decoded samples using the assigned grid positions from the first set of pseudorandomly generated numbers to provide synthesized speech.

11. The method of claim 10, further comprising the step of decoding the important samples from the assigned grid positions using the first set of pseudorandomly generated numbers to provide synthesized speech.

12. An apparatus for coding speech using regular-pulse excitation, the apparatus comprising:

a residual excitation signal generated from input speech;

a regular-pulse excitation analyzer that samples the residual excitation signal and codes the important samples defined per predetermined criteria using regular-pulse excitation;

regular-pulse excitation grid positions; and a pseudorandom number generator coupled to the analyzer, the pseudorandom number generator generates pseudorandom numbers to assign the grid positions of each of the important samples; and further comprising a downsampler and a quantizer coupled to the regular-pulse excitation analyzer, the downsampler decimates the samples by three, and the quantizer quantizes the values of the decimated samples into at least two-bits, wherein the pseudorandom number generator is coupled to the quantizer, and wherein the quantizer replaces one of the bits of each the decimated samples with a bit generated from the pseudorandom number generator.

13. The apparatus of claim 12, wherein the one of the bits of each the decimated samples is the least significant bit.

14. The apparatus of claim 12, further comprising a lowpass filter coupled to the regular-pulse excitation analyzer, the lowpass filter to select the important samples of the residual signal.

15. An apparatus, comprising:

a coding apparatus to code speech using regular-pulse excitation and including:

a residual excitation signal generated from input speech;

a regular-pulse excitation analyzer that samples the residual excitation signal and codes the important samples defined per predetermined criteria using regular-pulse excitation;

regular-pulse excitation grid positions;

pseudorandom number generator coupled to the analyzer, the pseudorandom number generator generates pseudorandom numbers to assign the grid positions of each of the important samples; and further comprising a downsampler and a quantizer coupled to the regular-pulse excitation analyzer, the downsampler decimates the samples by three, and the quantizer quantizes the values of the decimated samples into at least two-bits, wherein the pseudorandom number generator is coupled to the quantizer, and wherein the quantizer replaces one of the bits of each the decimated samples with a bit generated from the pseudorandom number generator; and a decoding apparatus including a pulse decoder coupled to the quantizer, the pulse decoder decodes each quantized sample using the same bit from the pseudorandom number generator that was used when the decimated sample was quantized; and a regular-pulse excitation grid positioner coupled to the pulse decoder, the speech synthesizer positions the decoded samples using the assigned grid positions defined by the pseudorandom number generator to provide synthesized speech.

16. The apparatus of claim 15, further comprising a speech enhancement postfilter coupled to the speech synthesizer to filter and enhance the synthesized speech.

* * * * *